United States Patent [19]

Lee et al.

[11] Patent Number: 4,814,736

[45] Date of Patent: Mar. 21, 1989

[54] WOUND TRANSFORMER CORE

[75] Inventors: Albert C. Lee, Hickory; Donald E. Ballard, Conover, both of N.C.

[73] Assignee: General Electric Company, King of Prussia, Pa.

[21] Appl. No.: 151,126

[22] Filed: Feb. 1, 1988

Related U.S. Application Data

[62] Division of Ser. No. 839,234, Mar. 13, 1986, Pat. No. 4,741,096.

[51] Int. Cl.[4] ..... H01F 27/24

[52] U.S. Cl. ..... 336/213; 336/217

[58] Field of Search ..... 29/602 R, 605, 607, 29/609; 336/211, 213, 216, 217, 234

[56] References Cited

U.S. PATENT DOCUMENTS

| | | | |
|---|---|---|---|
| 2,489,625 | 11/1949 | Dornbush | 336/213 X |
| 2,860,405 | 11/1958 | Smith | 29/602 R |
| 2,931,993 | 4/1960 | Dornbush | 336/217 |
| 2,960,756 | 11/1960 | Treanor | 336/217 X |
| 2,972,804 | 2/1961 | Ellis | 336/217 X |
| 2,995,720 | 8/1961 | Smith | 336/217 |
| 3,066,388 | 12/1962 | Cooper | 336/217 X |
| 3,104,364 | 9/1963 | Richardson, Jr. | 336/217 X |
| 3,154,758 | 10/1964 | Ellis | 336/213 X |
| 3,307,132 | 2/1967 | Ellis | 336/213 X |
| 3,613,229 | 10/1971 | Olsen et al. | 336/217 X |

*Primary Examiner*—Thomas J. Kozma

*Attorney, Agent, or Firm*—Henry J. Policinski; William Freedman; Robert A. Cahill

[57] ABSTRACT

A transformer core is made by winding a strip of ferromagnetic material, such as amorphous metal or silicon iron, on a winding mandrel to form a first annulus and cutting once through this annulus to create a plurality of individual laminations which are then assembled in packets about a nesting mandrel of a smaller diameter than the winding mandrel to form a second annulus. Each packet consist of a predetermined number of groups of laminations, with the ends of each lamination group lapping each other to form a lap joint. The lap joints of each packet are arranged in staggered positions to create a repeating step-lap joint pattern confined within a predetermined joint region. By decreasing the lap joint dimension and increasing the number of groups in successively assembled packets, the increase in build of the joint region over that of the remainder of the second annulus is minimized. The complete transformer core is uniquely characterized by its variable lap joint dimension and the absence of short sheets.

9 Claims, 3 Drawing Sheets

WOUND TRANSFORMER CORE

This is a division of application Ser. No. 839,234, filed Mar. 13, 1986 now U.S. Pat. No. 4,741,096.

BACKGROUND OF THE INVENTION

The invention herein disclosed is based upon work sponsored in part by the Electric Power Research Institute, Palo Alto, Calif.

The present invention relates to transformer cores and particularly to transformer cores wound from a strip of ferromagnetic material.

A wound core is the typical configuration utilized in high volume transformers, such as distribution transformer, as it is conducive to mechanized, mass production manufacturing techniques. Although equipment has been developed to wind a ferromagnetic core strip around and through the window of a preformed, multiturn coil to produce a core and coil assembly, the most common manufacturing procedure is to wind the core independently of the preformed coil or coils with which it will ultimately be linked. This means that the core must be formed with a joint at which the core laminations can be separated to open the core and thus accommodate insertion of the core into the coil window(s). The core is then closed to remake the joint. This procedure is commonly referred to as "lacing" the core with a coil. It is of course desirable from the standpoint of operating efficiency that the magnetic reluctance of this core joint be as low as possible. Moreover, the core joint should not unduly alter the distribution of the flux flowing through the joint region.

One common type of wound core joint is the so-called step-butt joint wherein the ends of each individual lamination are butted together. Thus the plural laminations are all concentrically arranged. The positions of these individual butt joints are typically staggered throughout the core build, and thus the overall core joint has the appearance of flights of stairs, hence the term "step". While this type of core joint is convenient to produce, it results in relatively high core losses. Moreover, since the flux in each lamination, in completing its closed loop path, prefers to cross over into adjacent laminations rather than jump the high-reluctance air gap of its butt-jointed ends, the flux density in the joint region rises above the flux density existing elsewhere in the core. As a result, the core material in the joint region can become saturated since the most economical core design calls for the operating flux density to closely approach the saturation level of the core material in order to minimize the amount of core material required. In the case of amorphous metal cores, the joint configuration becomes a significant limiting factor, as the flux saturation level of amorphous metal is approximately 75% that of silicon iron.

Another joint configuration commonly utilized in wound core constructions is a step-lap joint, wherein the ends of each lamination are lapped with each other. Again, the positions of these lap joints are typically offset or staggered repeating in stairstep fashion. This joint configuration produces an extra build-up in the cross sectional area of the core in the joint region, which appears as a bump. To avoid this bump, manufacturers have added a so-called "short sheet" to the core build each time the step pattern of lap joints is repeated. This short sheet is a partial length lamination having one of its ends butted with the overlapping end of the last lamination of one step pattern of lap joints and the other of its ends butted with the underlapping end of the first lamination of the next step lap joint pattern. The presence of these short sheets builds up the cross section of the rest of the wound core to equal the cross section of the joint region. With the presence of these short sheets, the plural laminations appear as a continuous spiral form the inside to the outside of the core. It is also characterized with lap joints of a constant lap dimension throughout the core. The step-lap core joint has a similar flux saturation limitation to that of the step-butt core joint in that the flux in the short sheets must cross over into adjacent, full length laminations in order to complete their closed loop paths. This crossover flux adds to the flux already flowing in these adjacent laminations and can drive the core material in the joint region into saturation. An additional drawback to this step-lap joint construction is the additional core material represented by the short sheets In the case of amorphous metal cores, additional material is already required to compensate for its lower saturation level as compared with silicon iron, and thus a step-lap joint with short sheets implemented in amorphous metal represents a significant cost penalty for the sake of achieving the lower core loss characteristics afforded by this material.

It is accordingly an object of the present invention to provide an improved wound transformer core.

A further object is to provide a wound transformer core having a more efficient joint configuration.

Another object is to provide a wound transformer core of the above-character having a step-lap joint wherein the extra build-up of the core cross section in the joint region is minimized.

An additional object is to provide a transformer core of the above-character whose joint is configured such that the saturation level of the joint region is substantially equal to that of the remainder of the core.

Yet another object is to provide a wound transformer core of the above-character which is constructed to make efficient use of core material.

Another object of the present invention is to provide a method for manufacturing a wound transformer core of the above-noted character.

Other objects of the invention will in part be obvious and in part appear hereinafter.

SUMMARY OF THE INVENTION

In accordance with the present invention, there is provided an improved wound transformer core of a generally rectangular shape having four interconnected sides circumscribing a core window. The core sides comprise individually nested strips of a ferromagnetic material arranged in packets; each packet comprising a predetermined number of lamination groups, with each group consisting of at least one lamination strip. Each lamination group is arranged with its ends in lapped relation to form a lap joint. Within each packet, these lap joints are circumferentially offset by essentially butting together the ends of the immediately adjacent lamination groups to create a step-lap joint pattern which is repeated within each lamination packet. This repeating step-lap joint pattern is located in a joint region confined to one of the core sides. To economize on the amount of material in the core, partial length laminations or short sheets are dispensed with. The resulting additional build-up in the joint region is however minimized by decreasing the lap dimension of the lap joints and increasing the number of lamination groups in the lamination packets as the packet positions progress outwardly from the core window, thus reducing the number of lamination packets required to complete the core build. Thus, the core is characterized as having lap joints with varying lap dimensions from the inside to the outside of the core. The resulting wound core is less bulky and thus utilizes less core material, and the joint region thereof has a magnetic saturation level comparable to that of the other three core sides.

To manufacture the wound core generally described above, a strip of ferromagnetic material, which can either be highly grain oriented silicon iron or amorphous metal, is tightly wound about a winding mandrel to form a first annulus. This first annulus is then cut through at one location along a single radial line to create a multiplicity of separate lamination strips which are then tightly formed about a nesting mandrel of a smaller diameter than the winding mandrel to produce a second annulus. In the process, these lamination strips are arranged in lamination groups and the lamination groups in lamination packets to create the above-described joint region consisting of repeating step-lap joint patterns.

The second annulus is then formed into a rectangular shape and annealed to produce the four-sided wound core of the invention.

The invention accordingly comprises the features of construction of an article of manufacture and the method step for manufacturing said article, all of which will be exemplified in the Detailed Description hereinafter set forth, and the scope of the invention will be indicated in the claims.

BRIEF DESCRIPTION OF THE DRAWINGS

For a full understanding of the nature and objects of the present invention, reference may be had to the following Detailed Description taken in conjunction with the accompanying drawings, in which.

Like reference numerals refer to corresponding parts throughout the several views of the drawings.

DETAILED DESCRIPTION

Figure 1:
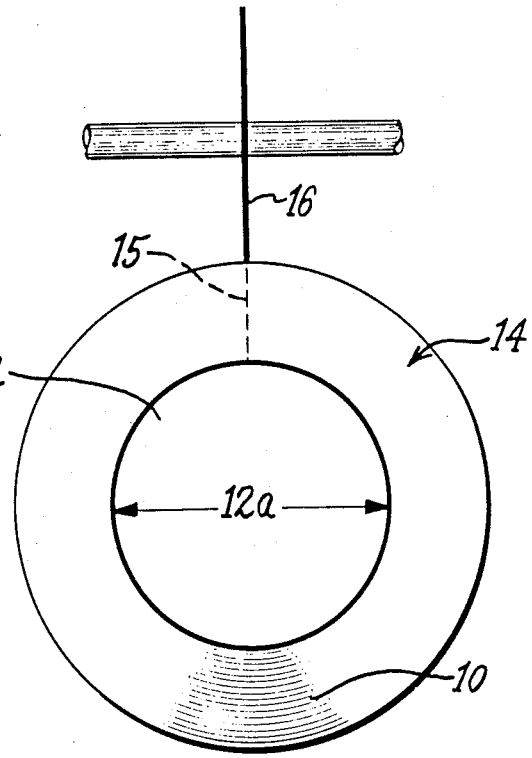
FIG. 1 is a side elevational view of a first annulus of ferromagnetic strip material wound on a winding mandrel and cut to provide a multiplicity of single turn laminations.
Figure 1A:
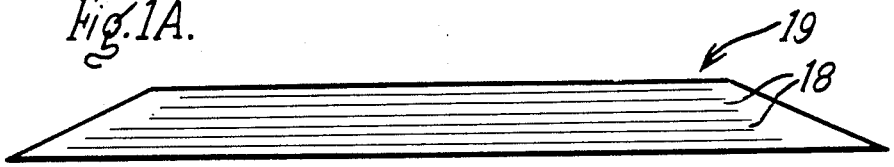
FIG. 1A is a side elevational view of the cut lamination strips arranged in a stack.

Referring first to FIG. 1, the wound transformer core of the invention is produced by first tightly winding a strip 10 of ferromagnetic material, which may be highly grain oriented silicon iron but preferably is amorphous metal, on a winding mandrel 12 of a diameter 12*a* to create a first annulus 14. A suitable amorphous strip material is one marketed by Allied Corporation of Morristown, N.J. as its METGLAS Type 2605-S2 material. Annulus 14 is then severed at one location along a single radial line 15 by a thin rotating cutting wheel 16 to produce a multiplicity of separate lamination strips 18 which fall into a stack, indicated at 19 in FIG. 1A. Preferably, annulus 14 is removed from mandrel 12 prior to its severance by cutting wheel 16.

Figure 2:
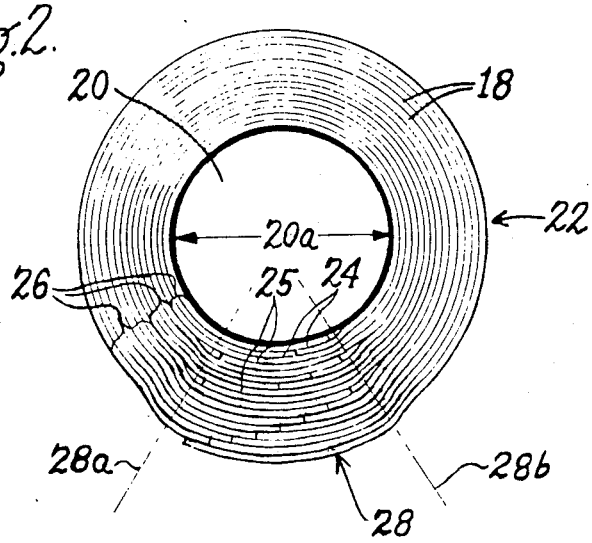
FIG. 2 is a side elevational of a smaller diameter nesting mandrel about which the cut laminations of FIG. 1 are formed and arranged to create a second annulus containing the step-lap core joint of the present invention.

The cut laminations 18 are then tightly formed about a nesting mandrel 20, seen in FIG. 2, whose diameter 20*a* is smaller by a predetermined amount than the diameter 12*a* of mandrel 12, seen in FIG. 1, to create a second annulus 22. This nesting procedure may be performed manually or by suitable machinery, not shown. Consequently, the end portions of each lamination 18 are lapped with each other to create a lap joint, indicated at 24. In addition, the laminations are arranged into multiple packets, three of which are shown at 26 in FIG. 2. Each packet includes a predetermined number of laminations relatively positioned such that the overlapped end portion of one lamination is butted, as indicated at 25, with the underlapped end portion of the immediately adjacent, overlying lamination. Thus, the laminations within each packet are effectively arranged end-to-end in a coil or spiralled configuration about mandrel 20. The net result is that the lap joints 24 within each packet 26 are angularly offset to create a stairstep pattern, and thus the series of lap joints within a packet may be considered as constituting a step-lap joint. The laminations of the various packets 26 are arranged such that this step-lap joint pattern is repeated within each packet while being confined to a predetermined joint region 28 whose boundaries are essentially defined by lines 28*a* and 28*b*.

Figure 3:
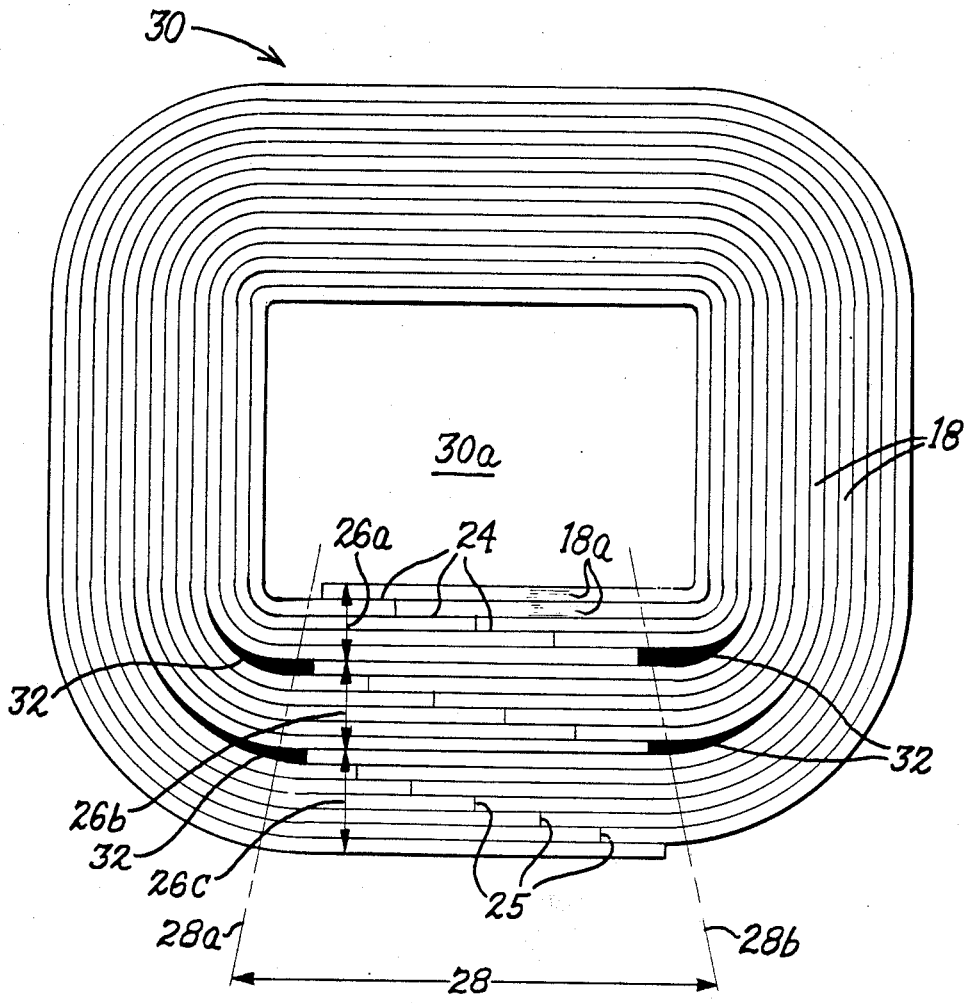
FIG. 3 is an enlarged side elevational view of the joint region of the annulus of FIG. 2 after it has been formed into a rectangularly shaped core.

Annulus 22 is then removed from mandrel 20 and formed into the generally rectangular shape of a typical wound transformer core, indicated at 30 in FIG. 3, by conventional means, not shown. Suitable annealing plates (not shown) are applied to the core, following which it is heated in a suitable oven at temperatures of about 360° C. for approximately two hours while being subjected to a magnetic field in the presence of a nitrogen gas atmosphere. As is well understood, annealing acts to relieve stresses in the core material, including those imparted during the winding, cutting, lamination arranging and nesting, and core shaping steps.

Following the annealing step, the step-lap joints in the joint region 28, which is seen in FIG. 3 to be confined to one of the four sides of core 30, are separated to open the core and allow insertion of the core into the window of a preformed coil (not shown). The step-lap joints are then reclosed. The opening, inserting, and reclosing steps are often commonly referred to as "lacing" the core into the coil or coils.

By referring to FIG. 3, wherein joint region 28 of annulus 22 of FIG. 2 is shown in enlargement, the arrangement of the laminations 18 into packets can be more clearly seen. While core 30 is depicted as including three lamination packets 26*a*, 26*b* and 26*c*, in practice the number of packets would be greater. Also more clearly seen in FIG. 3 is the lapping of the end portions of each lamination to create the individual lap joints 24 and the end-to-end butting relationship at 25 of the adjacent laminations within each packet. The extent of lamination end lapping is determined by the difference in the diameters of mandrels 12 (FIG. 1) and 20 (FIG. 2) and the relative space factors of the annuluses 14 and 22. As is well understood in the art, space factor is largely a function of the tightness at which strip 10 is wound to form annulus 14, the tightness at which the laminations 18 are formed about nesting mandrel 20 to create annulus 22, the surface smoothness of strip 10, and the uniformity of thickness of the strip from one lateral edge to the other. The transition from packet to packet is characterized by the presence of a pair of voids 32, one at the trailing end of the outermost lamination of one packet and the other at the leading end of the innermost lamination of the immediately adjacent, overlying packet. Normally, these voids are eliminated by the inclusion of a partial length lamination or "short sheet" in each packet-to-packet transition. As will be explained in conjunction with FIG. 4A, the presence of these short sheets causes an undesirable increase in the flux density within joint region 28, and thus short sheets are purposely avoided in core 30 of the present invention.

Still referring to FIG. 3, it is seen that, due to the utilization of lap joints 24 at the ends of the laminations, there is an additional build-up of the core cross section in the side including joint region 28 as compared to the other three sides. This additional build-up increases the bulk of the core and represents additional core material and associated costs. While an increase in the core cross section in the joint region is unavoidable where lap joints without short sheets are involved, it is an important object of the present invention to minimize this increased cross section in the joint region relative to the other three core sides. It can be seen that each packet contributes to this additional build-up in the joint region by an amount equal to the thickness of one lamination 18. Thus, in the illustration of FIG. 3, the additional build-up of the joint region beyond that of the other three core sides is the thickness of three laminations 18. To minimize this additional build-up in accordance with the present invention, a fewer number of lamination packets are utilized in completing the core build. This is achieved by increasing the number of laminations 18 in the packets as their positions become more remote relative to core window 30*a*. Thus, as seen in FIG. 3, lamination packet 26*a* includes five laminations, packet 26*b* includes six laminations, and packet 26*c* includes seven laminations. The inclusion of increased numbers of laminations in the outer packets is made possible because the joint region 28 can be of a keystone configuration, i.e., the length of the joint region can be expanded as it progresses outwardly from window 30*a* without conflicting with the corner regions. Also, by virtue of the additional build-up in the joint region, the extent of overlap of the end portions of the laminations, i.e., the lap dimension of the lap joints 24, progressively decreases from the innermost to the outermost packets, assuming the space factors of annuluses 14 and 22 to be substantially equal. In this connection, the diameter of the smaller nesting mandrel 20 (FIG. 2) relative to the diameter of the large winding mandrel 12 (FIG. 1) is selected in order to achieve a minimum lap dimension of the lap joints in the outermost packet in the range of 0.3 to 0.5 inches. The number of packets utilized is selected in order to bring the maximum lap dimension of the lap joints in the innermost packet within the range of 0.5 to 0.9 inches.

It will be appreciated that in practice, the increase in laminations per packet may not be effected from packet to packet in uniform progression, as illustrated in FIG. 3. That is, the increase in the number of laminations per packet may be accomplished with every other packet or every third packet as the core build progresses outwardly from the core window.

As indicated above, it is preferred that core 30 be formed of ferromagnetic amorphous metal. Amorphous metal in strip form, at present, is producible only in a very thin gauge, nominally one mil thick. Silicon iron strips utilized in winding transformer cores are typically in the range of seven to twelve mils thick. Moreover, amorphous metal strip material is quite brittle and must be handled with extreme care to prevent chipping and fracturing during the core manufacturing process. As a consequence, amorphous metal strips are best handled in groups. Thus the laminations 18 illustrated in FIGS. 2 and 3, are each comprised of a group of from five to thirty and preferably from ten to twenty amorphous metal strips or laminations, as indicated at 18*a* in FIG. 3. Reference may be had to the commonly assigned, copending Ballard et al. application entitled Amorphous Metal Transformer Core and Coil Assembly and Method of Manufacturing Same, U.S. Ser. No. 804,412, filed Dec. 4, 1985, which discloses a method for manufacturing a transformer core wound from an amorphous metal strip. It will be appreciated that if core 30 is wound with the thicker silicon iron strip, each lamination 18 illustrated in the drawings would typically consist of a single strip, although several such strips may be grouped together to form each illustrated lamination.

Figure 4A:
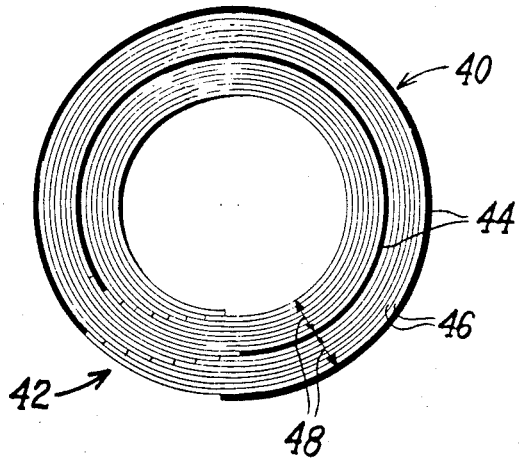
FIGS. 4A and 4B are side elevational view of wound transformer cores having joint configurations constructed in accordance with the prior art.
Figure 4B:
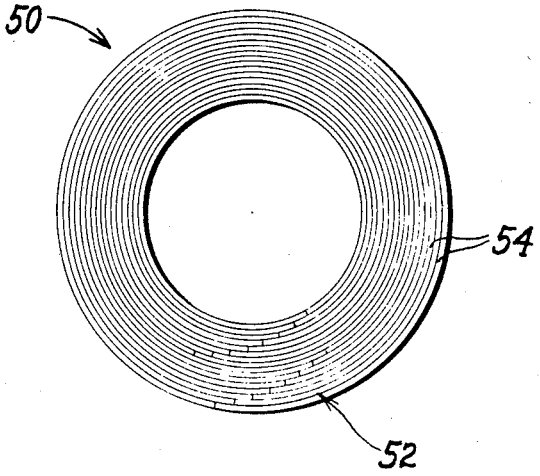

To appreciate the benefits afforded by the present invention insofar as joint region flux density is concerned, reference is made to FIGS. 4A and 4B. The former figure illustrates a core 40 constructed with a step-lap joint, generally indicated at 42, plus the inclusion of a partial length lamination or short sheet 44 in each packet-to-packet transition. It is seen that with the inclusion of these short sheets, the cross section or build of the core 40 is uniform throughout. The lamination 46 is a continuous spiral starting from the inside to the outside of core 40. Moreover, the individual full length laminations 46 together with the short sheets 44 are arranged in a continuous spiral throughout the core build. With regard to the flux flowing in these short sheets, it will be noted that this flux must cross over into the adjacent full length laminations 46 in order to complete its closed loop path between the widely separated ends of the short sheets. This short sheet flux thus adds to the normal flux flowing in these adjacent lamination, thus increasing the flux density in the portions of these laminations within the joint region. If the core 40 is operating close to the flux density saturation level of the core material, as is typically desired from a design economy standpoint, the addition of this crossover flux will cause the core material in the joint region to go into saturation. For example, in the case of a core 40 having seven lamination plus a short sheet in each packet 48, the flux density in the joint region is increased by the factor 8/7 or 14%. It is seen that this presents a significant restraint on the allowable induction level of the core in order to avoid saturating the core material in the joint region. This situation is exacerbated where the core material is amorphous metal rather than silicon iron, since, as noted previously, the former has approximately a 25% lower flux saturation level.

The same situation pertains in the core 50 of FIG. 4B which is illustrated as being constructed with a step-butt joint, generally indicated at 52. Thus, the laminations 54 are concentrically arranged with the two ends of each lamination in abutting relation. The flux flowing in each lamination crosses over into the adjacent laminations lapped therewith as this typically constitutes a lower reluctance path than the high reluctance of the inevitable air gap in the butt joint. This crossover flux increases the flux density in the joint region in the manner and substantially to the same degree as in the case of core 40 in FIG. 4A.

As is readily seen in FIG. 3, there is no crossover flux in joint region 28 of core 30 to increase the flux density therein. The flux flowing in each lamination 18 simply completes its loop path by flowing through the low reluctance lap joint 24 interconnecting its two ends, and thus has no tendency to cross over into adjacent laminations. Thus, core 30 of the present invention may be operated at flux density levels approaching the saturation level of the core material without fear of saturating the joint region. A more economical core construction is thus provided, since less core material is required to operate at optimum design levels of magnetic induction.

The following table illustrates additional benefits (based on actual test results using model cores) of the present invention in terms of reductions in core loss (C/L) in watts/kilogram and exciting power (E/P) in volt amperes/kilogram at various levels of magnetic induction in teslas (T) for both silicon iron (SiFe) and amorphous metal (AM) cores. The various core loss and exciting power values for a core having a step-lap joint and short sheets, e.g., core 40 of FIG. 4A, and a core having a step-butt joint, e.g. core 50 of FIG. 4B, are expressed in per units of the corresponding values for core 30 (FIG. 3) of the present invention.

| Mat'l Flux Density | | Core 30 | | Core 40 | | Core 50 | |
|---|---|---|---|---|---|---|---|
| | | C/L | E/P | C/L | E/P | C/L | E/P |
| SiFe | 1.5 T | 1.0 | 1.0 | 1.05 | 1.11 | 1.09 | 1.18 |
| | 1.7 T | 1.0 | 1.0 | 1.07 | 1.49 | 1.10 | 1.67 |
| AM | 1.3 T | 1.0 | 1.0 | 1.18 | 2.60 | 1.37 | 2.94 |
| | 1.4 T | 1.0 | 1.0 | 1.17 | 2.81 | 1.40 | 3.94 |

As can be readily seen from this table, the joint configurations of cores 40 and 50 result in consistently higher levels of core loss and exciting power at the indicated induction levels, as compared to the joint configuration of core 30, and thus the latter offers rather dramatic improvements in these very important design parameters.

It is thus seen that the objects of the present invention set forth above, including those made apparent from the preceding description, are efficiently attained and, since certain changes may be made in the above construction and method of achieving same without departing from the scope of the invention, it is intended that all matters contained in the above description and shown in the accompanying drawings shall be interpreted as illustrative and not in a limiting sense.

Having described the invention, what is claimed as new and desired to secure by Letter Patent is:

1. A wound transformer core of a generally rectangular shape having four interconnected sides circumscribing a core window, said sides comprised of nested laminations of a ferromagnetic strip material, said turns having each been cut at a predetermined place while tightly coiled in an annulus and being arranged in packets each consisting of a predetermined number of groups each of at least one lamination, the ends of each said group being lapped with one another to form a lap joint and being essentially butted with the ends of the immediately adjacent groups such that said groups of each said packet are arranged in spiralling relationship, said lapped joints of each said packet being laterally displaced from each other to provide a step-lap joint pattern, said step-lap joint pattern being repeated from packet to packet within a joint region located exclusively in one of said sides, the build of said one side being greater than the uniform builds of said other sides, and the number of said groups in said packets being varied in accordance with the packet position relative to said window, such as to reduce the number of said packets required to build said core and thereby limit the increase in the build of said one side relative to the build of said other sides.

2. The transformer core defined in claim 1, wherein said ferromagnetic strip is comprised of amorphous metal.

3. The transformer core defined in claim 2, wherein each said group is comprised of from 5 to 30 said laminations.

4. The transformer core defined in claim 1, wherein the lap dimension of said lap joints in said packets generally decreases as the packet positions progress outwardly from said window.

5. The transformer core defined in claim 4, wherein the number of said groups per packet increases as the packet positions progress outwardly from said window.

6. The transformer core defined in claim 5, wherein said ferromagnetic strip is comprised of amorphous metal.

7. The transformer core defined in claim 6, wherein each said group is comprised of from 10 to 20 said laminations.

8. The transformer core defined in claim 3, wherein the lap dimension of said lap joints in said packet outermost from said window is in the range of 0.3 to 0.5 inches.

9. The transformer core defined in claim 8, wherein the lap dimension of said lap joints in said packet immediately adjacent said window is limited to approximately 0.5 to 0.9 inches.

* * * * *

UNITED STATES PATENT AND TRADEMARK OFFICE

CERTIFICATE OF CORRECTION

PATENT NO. : 4,814,736

DATED : March 21, 1989

INVENTOR(S) : Albert C. Lee and Donald E. Ballard

It is certified that error appears in the above—identified patent and that said Letters Patent is hereby corrected as shown below:

In claim 1, line 4, "turns" should read - laminations --

In claim 1, lines 5-6, "while tightly coiled in an annulus" should be deleted.

In claim 8, line 1, "3" should read - 4 -

Signed and Sealed this

Third Day of October, 1989

*Attest:*

DONALD J. QUIGG

*Attesting Officer*

*Commissioner of Patents and Trademarks*